US005402998A

United States Patent [19]

Sleve et al.

[11] Patent Number: 5,402,998

[45] Date of Patent: Apr. 4, 1995

[54] O-RING REVERSING DRIVE COUPLING

[75] Inventors: Jerome F. Sleve, Henrietta; Gerald M. Darby, II, Brockport; Michael T. Haupt, Webster, all of N.Y.

[73] Assignee: Eastman Kodak Company, Rochester, N.Y.

[21] Appl. No.: 47,317

[22] Filed: Apr. 15, 1993

[51] Int. Cl.[6] ..... B65H 5/00

[52] U.S. Cl. ..... 271/272; 271/273

[58] Field of Search ..... 271/272, 273, 274; 226/188

[56] References Cited

U.S. PATENT DOCUMENTS

| | | | |
|---|---|---|---|
| 119,674 | 10/1871 | Weaver . | |
| 897,756 | 9/1908 | Marshall | 226/188 X |
| 2,079,351 | 5/1937 | Judelshon | 74/236 |
| 2,775,131 | 12/1956 | Smits | 74/221 |
| 2,950,810 | 8/1960 | Reynolds | 226/188 X |
| 3,246,822 | 4/1966 | Skeen | 271/273 X |
| 3,447,729 | 6/1969 | Cass | 226/188 X |
| 3,534,634 | 10/1970 | Kawanami | 74/722 |
| 3,561,134 | 2/1971 | Kruckels | 226/188 X |
| 4,279,413 | 7/1981 | Siwik | 271/274 |
| 4,971,293 | 11/1990 | Roberson | 226/188 X |

*Primary Examiner*—David H. Bollinger
*Attorney, Agent, or Firm*—Lawrence P. Kessler

[57] ABSTRACT

A coupling, supportable by a first and second O-ring belt, has two gear sheaves in mating contact. The inner portion of each gear sheave has a friction surface for mating with one of the O-ring belts. The rotational drive of the first O-ring is imparted to the first of the gear sheaves through the first frictional surface causing the sheave to rotate. The rotation of the first sheave then causes the second sheave, through the mating gears, to rotate in a direction opposite the direction of the first gear sheave. The frictional surface of the second sheave then imparts the rotation of the second sheave to the second O-ring. In this manner the rotational drive of the first O-ring is reversed when transmitted by the second O-ring as said O-rings support said sheaves.

2 Claims, 5 Drawing Sheets

O-RING REVERSING DRIVE COUPLING

BACKGROUND OF THE INVENTION

FIELD OF THE INVENTION

The invention described in this specification is primarily intended to be utilized in conjunction with a transport drive system. While it is not necessarily limited to any particular use, it is especially advantageous when used in conjunction with a paper transport system of the type used in an electrophotographic reproduction apparatus where a single motor may have to drive paper transport rollers in more than one rotary direction.

DESCRIPTION OF THE PRIOR ART

It is known from U.S. Pat. No. 119,674 to have a drive system where sheaves and their drive belts mount between stationary support members located on the lateral sides of said sheaves. It is also known in the art to have the driven sheave rotating in a direction opposite to that of its drive sheave by crossing a common drive belt between the drive and driven sheave in the form of a figure eight.

While both of the above drive systems accomplish their intended purposes, the drive systems are application dependent because they have to be specifically designed to the fixed locations of the drive and driven sheaves. In addition, twisting the belt into a figure eight to obtain the reversing drive causes excessive wear to the belt necessitating frequent belt replacement.

It is therefore an object of the present invention to provide a coupling apparatus that allows the driven and drive sheave to move in opposite directions, without excessive wear to the drive belts and without the application dependence limitations of the prior art.

SUMMARY OF THE INVENTION

There is disclosed herein a new and useful coupling apparatus for reversing the drive between driven and drive components.

According to a specific embodiment of the invention, the coupling apparatus comprises:

first linking means for receiving a rotational drive, second linking means for transmitting a rotational drive, and rotating means supportable by and in mating contact with the first and second linking means for accepting the rotational drive transmitted by the first linking means, reversing said rotational drive and transmitting to said second linking means the reversed rotational drive.

A brief summary of the above type is inherently incapable of delineating many facets and features of an invention which are significant and important to indicate the many advantages of the invention as are normally apparent to one skilled in the art after a detailed study of the invention. It is considered that such items will be apparent to one skilled in the art from a detailed consideration of the remainder of this specification, the appended claims and the accompanying drawings.

An advantage to the above is that the coupling floats between the linking means and therefore does not require special mounting to locate the coupling so as not to interfere with other components.

Another advantage is that a wide variety of speeds may be transmitted between the linking means by merely changing the dimensions of the linking means or the rotating means. The foregoing advantages make the coupling a universal drive transmission component as opposed to the application dependent drive transmission components, such as disclosed in the prior art.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENT

Figure 1:
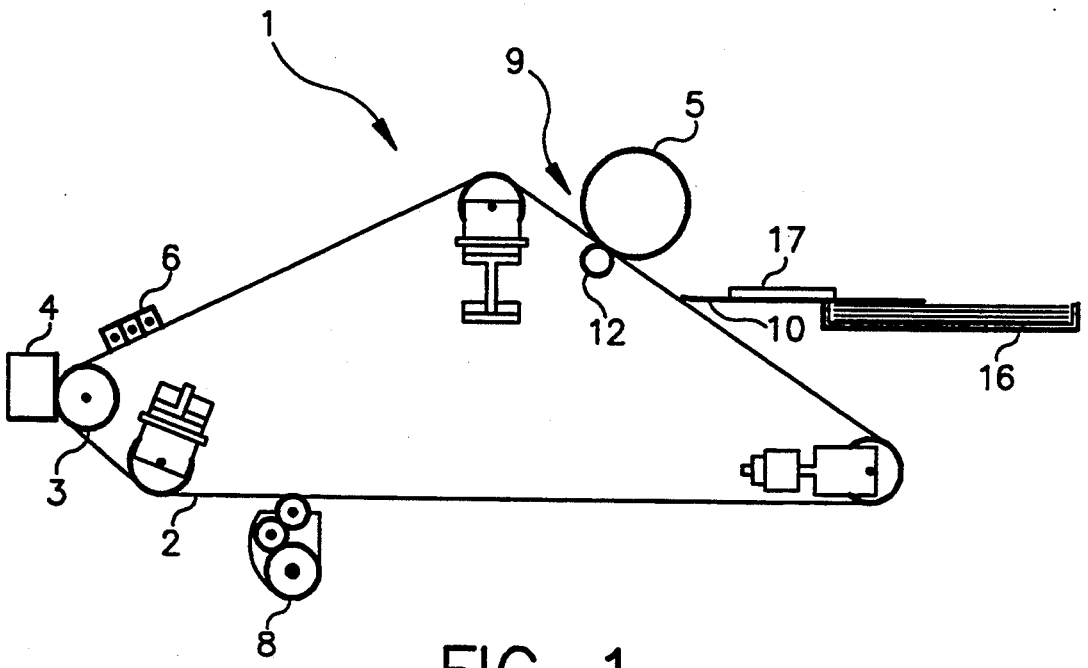
FIG. 1 (PRIOR ART)
FIG. 1 is a schematic side view of a typical prior art photocopying apparatus, but with parts eliminated for clarity of illustration.

The apparatus of the preferred embodiment will be described in accordance with an electrostatographic recording medium. The invention, however, is not limited to methods and apparatus for creating images on such a medium, as other media such as photographic film, etc., may also be used to advantage within the spirit of the invention.

Because electrostatographic reproduction apparatus are well known, the present description will be directed in particular to elements forming part of, or cooperating more directly with, the present invention. Apparatus not specifically shown or described herein are selectable from those known in the art.

While the present invention is susceptible to embodiments of many different forms, there is shown in the drawings and hereinafter described, in detail, a preferred embodiment of the invention. It should be understood, however, that the present disclosure is to be considered an exemplification of the principles of the invention and is not intended to limit the invention to the embodiments illustrated and/or described.

For ease of description, all apparatus will be described in their normal operational position, and terms such as upper, lower, horizontal, etc., will be used with reference to normal operating positions. All apparatus, however, may be manufactured, stored, transported and sold in an orientation other than the normal operational positions described.

All references cited in this specification, and their references, are incorporated by reference herein where appropriate for appropriate teaching of additional or alternative details, features and/or technical background.

Throughout the following description, similar reference characters refer to similar elements or members in all of the drawing figures.

Referring initially to FIG. 1, a prior art film core portion of a copier or printer, generally designated 1, includes a recording medium, for example, an endless electrophotoconductive web 2 entrained about a series of rollers so that web 2 may be driven though a series of electrophotographic stations generally well-known in the art. More specifically, a uniform charge is laid down on web 2 by a charging station 6. Uniformly charged web 2 moves around a printhead roller 3 which is directly opposite an LED printhead 4. LED printhead 4 exposes web 2, in a manner well-known in the art, to form a latent image on web 2. Exposed web 2 then moves into operative relation with a toning or developing station 8. Each image, on web 2, created by printhead 4 is then toned at toning station 8. The toned image, carded on web 2, then passes adjacent a transfer station 9, consisting of a transfer drum 5 and a backup drum 12, where the image is transferred to a transfer medium 10, such as a sheet of paper, carried by transfer drum 5.

Transfer drum 5, as is well known in the art, cooperates with web 2 to incrementally bring sheet 10 and the toned image into transfer relation so that the toned image may be properly transferred to receiving sheet 10. After transfer is complete, sheet 10 is allowed to follow web 2 until it separates from web 2 and is transported to a fuser, known in the art, but not shown. Upon sheet 10 leaving the fuser it is directed to an output tray, known in the art, but not shown, for delivery to the apparatus operator.

Figure 2:
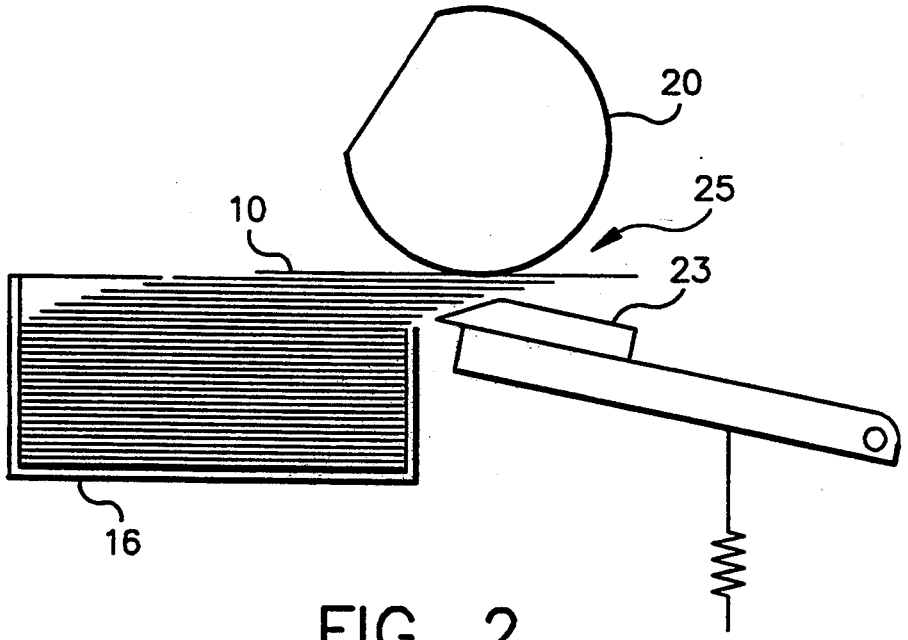
FIG. 2 (PRIOR ART)
FIG. 2 is a side view of a portion of a typical prior art sheet feeding apparatus, but with parts eliminated for clarity of illustration.
Figure 8:
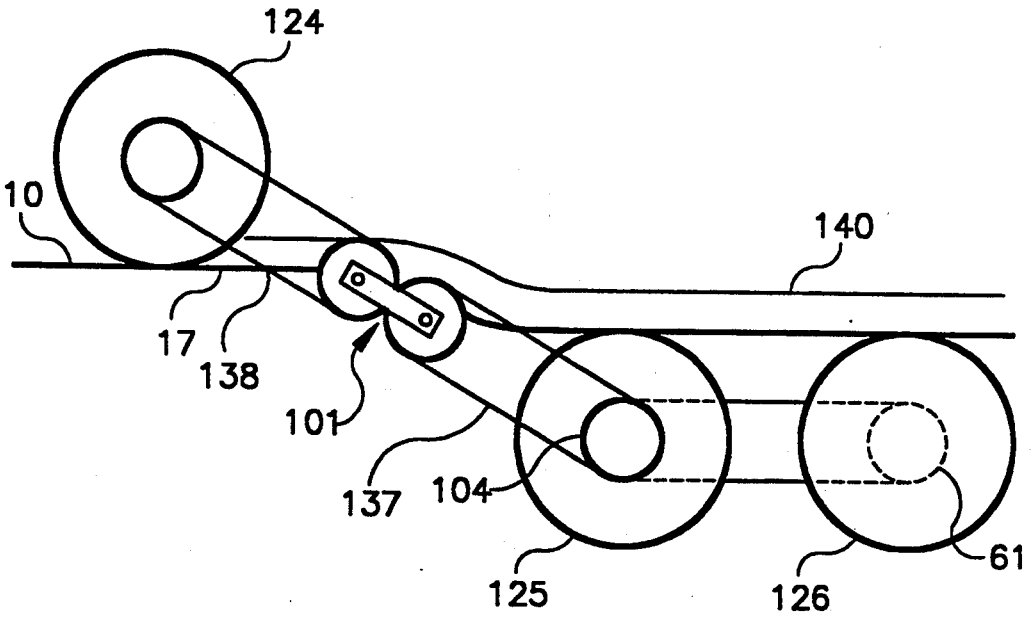
FIG. 8 is a side view of the reverse coupling apparatus of the present invention, used in combination with the typical paper transport of the electrophotographic reproduction device of FIG. 6.

In order to transfer the toned image to sheet 10, sheet 10 must be transported from a supply source 16, such as a paper supply cassette. The feeding of sheet 10 from cassette 16, briefly stated, may be accomplished in accordance with the following typical feed sequence. As shown in FIG. 2, uppermost sheet 10, of a sheet stack is caused to move forward from the stack by frictional contact with a segmented scuff feed roller 20. A retard pad 23, in biased cooperation with a portion of scuff feed roller 20, prevents all but uppermost sheet 10, of the stack, from advancing during each rotation of scuff feed roller 20 as scuff feed roller 20 overdrives uppermost sheet 10 past retard pad 23, through nip 25 and into engagement between roller 124 and transfer platform 17, see FIG. 8, of copier 1. Once sheet 10 is engaged between roller 124 and transfer platform 17, scuff feed roller 20 relinquishes frictional contact with sheet 10 and sheet 10 is thereafter fed by roller 124 toward drive rollers 125 and 126 where sheet 10 is fed over drive rollers 125 and 126 and between a sheet retainer 140, such as a plate or nip rollers, said nip rollers being known in the art, but not shown, of transfer platform 17. Rollers 124, 125 and 126 of transport platform 17 are driven by a single motor 18. It is how rollers 124, 125 and 126 are driven by motor 18, for transporting sheet 10 in the proper direction and at the proper speed, that is the subject matter of this invention, which for the purpose of illustration and not limitation is shown in relation to sheet transport platform 17 of copier 1.

Turning now specifically to rollers 124, 125 and 126 of transport platform 17, as sheet 10 makes contact with drive roller 124, drive roller 124 rotates to urge sheet 10 over transfer platform 17 toward drive rollers 125 and 126. However, since the drive for drive roller 124 is through sheave 127, see FIG. 6, which is indirectly driven by sheave 104, and sheet 10 travels under drive roller 124 and over drive roller 125, if the drive between sheave 104 and 127 were not reversed, the drive of rollers 125 and 124 would rotate in the same direction. This would cause a binding of sheet 10, between rollers 125 and 124. As previously stated, what had been done in the past, to prevent this binding was to twist the drive belt that directly connected sheave 104 and sheave 127. This twisting, however, caused undue wear to said drive belt and necessitated its frequent replacement. However, with the use of a reverse coupling 101, as hereinafter disclosed, the need to twist the drive belt, to accomplish the reversing action, is eliminated.

Figure 3:
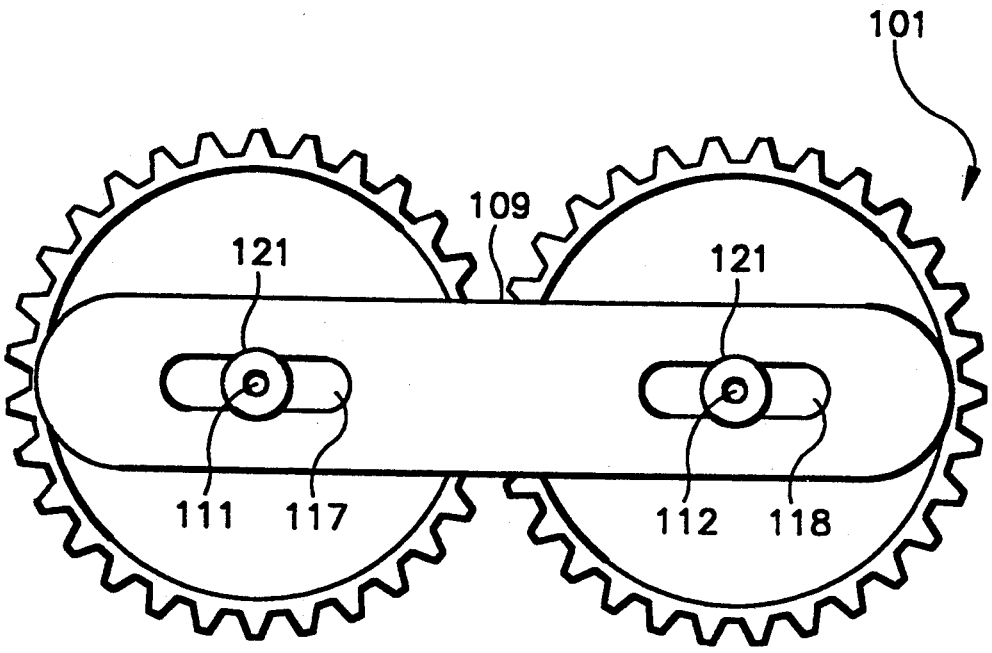
FIG. 3 is a front view of a reverse coupling apparatus, in accordance with the present invention.
Figure 4:
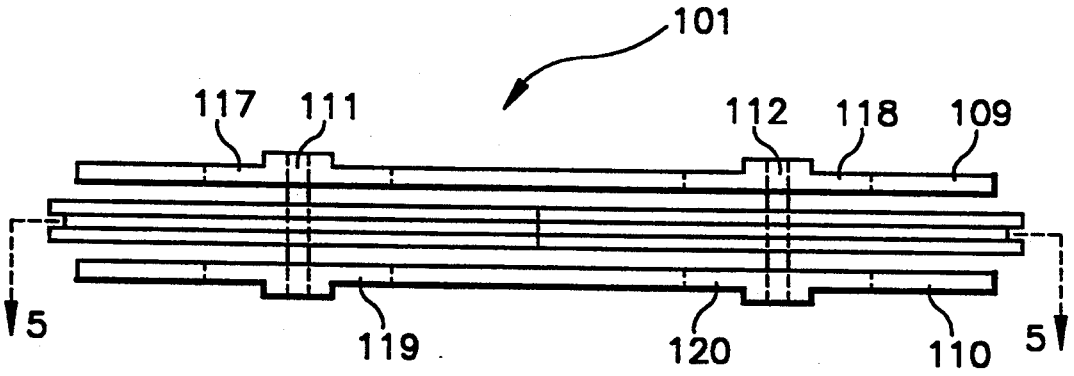
FIG. 4 is a top view of the reverse coupling, in accordance with the present invention.
Figure 5:
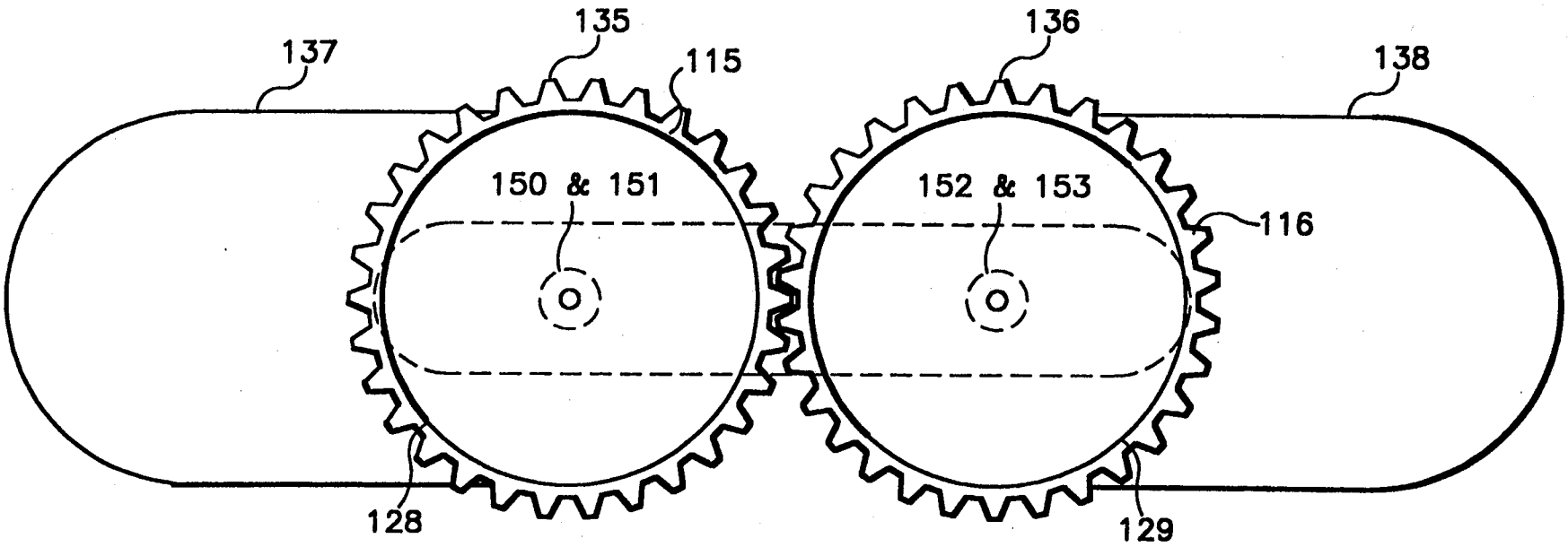
FIG. 5 is a sectional view of the reverse coupling apparatus taken through section 5—5 of FIG. 4, but with the slots of FIG. 4 replaced by retaining holes, in accordance with the present invention.
Figure 7:
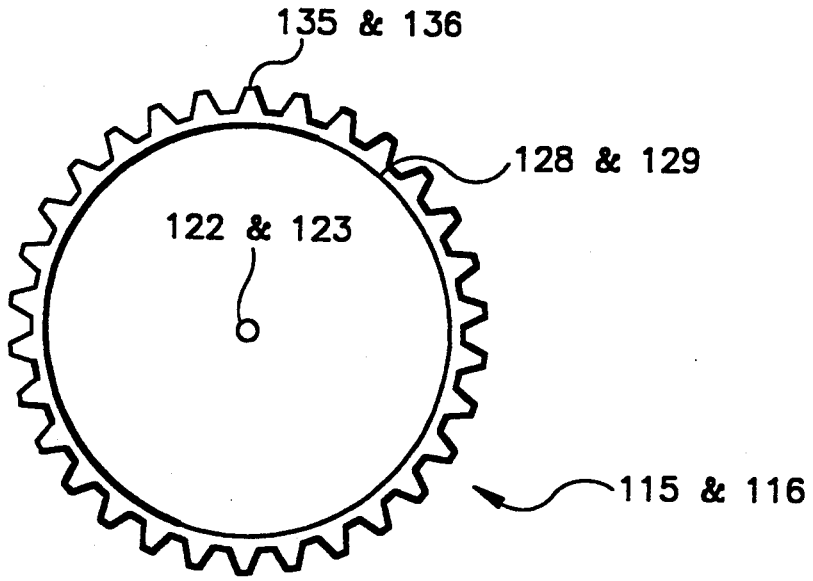
FIG. 7 is a side view of one of the sheaves of the reverse coupling apparatus of the present invention.

Referring now to FIGS. 3, 4 and 5, coupling 101 has side lateral retainers 109 and 110 which are joined by removable shafts 111 and 112. Removable shafts 111 and 112 are retained in side retainers 109 and 110 by shaft 111 being inserted in retaining holes 150 and 151 and shaft 112 being inserted in retaining holes 152 and 153, of a diameter approximating the outer diameter of shafts 111 and 112, for exact positioning of shafts 111 and 112 in retainers 109 and 110. However, to incorporate more versatility into coupling 101, holes 150–153 may be replaced with slots 117, 118, 119 and 120 wherein shaft 111 would be inserted through slots 117 and 119 in retainers 109 and 110 and shaft 112 inserted into slots 118 and 120 of retainers 109 and 110, respectively. Notwithstanding the fact that slots 117–112 or holes 150–153 may be used, a shoulder or other retaining means, as is known in the art, is associated with shafts 111 and 112 so that when shafts 111 and 112 are placed between lateral retainers 109 and 110, shafts 111 and 112 maintain lateral retainers 109 and 110 spaced apart a desired distance. A removable securing device 121, such as a retaining nut, is placed on both ends of shafts 111 and 112 to secure said shafts in their desired positions in holes 150–153 or within slots 117 through 120. Before, however, shafts 111 and 112 are secured in holes 150–153 or within slots 117–120, shaft 111 is placed through the center axis 122 of sheave 115 and shaft 112 is placed through the center axis 123 of sheave 116 (see FIG. 7) so that sheaves 115 and 116 are free to rotate on shafts 111 and 112 within the confines of lateral retainers 109 and 110. This securing of shafts 111 and 112 in holes 150–153 or within slots 117–120 of side retainers 109 and 110, positions sheaves 115 and 116 such that gear teeth 135 of sheave 115 mate with gear teeth 136 of sheave 116. While the use of slots 117–120 require alignment of shafts 111 and 112 in said slots, and the use of hole 150–153 assure immediate alignment, when slots 117–120 are used, shafts 111 and 112 may be moved in slots 117–120, thereby enabling coupling 101 to accommodate a variety of different diameter sheaves 115 and 116 without structural modification to coupling 101. This provides a convenient way to change the speed and power ratios transmitted through coupling 101 by merely changing the diameter of sheaves 115 and 116. While sheaves 115 and 116, teeth 135 and 136 and belt grooves 128 and 129 are depicted in FIG. 7 as identical, this is not always true. Depending on the power and speed to be transmitted by coupling 101 some or all of the parameters, of these elements, may not be the same. The method of changing speed and power transmitted through coupling 101 may be by changing the traverse or lateral diameter of belt groove 128 of sheave 115 and belt groove 129 of sheave 116, changing the diameter of O-ring belts 137 and 138 or by changing the outer diameter of sheaves 115 and 116 where gear teeth 135 and 136 are located, as later to be explained.

As shown in FIGS. 5 and 7, sheaves 115 and 116 have an outer circumference of gear teeth 135 and 136 for meshing with each other to transfer and transmit rotational motion between sheaves 115 and 116 and an inner circumference forming belt grooves 128 and 129 for transferring and transmitting rotational motion between O-ring 137 and sheave 115 and O-ring 138 and sheave 116 by friction contact between O-rings 137 and 138 and said sheaves. In this manner, since gear teeth 135 of sheave 115 and gear teeth 136 of sheave 116 mate, the rotation of sheave 115 must necessarily be opposite to the rotation of sheave 116. Therefore any input, from belt 137 to sheave 115, will be reversed so that the output of belt 138 of sheave 116 will be of opposite rotation. Further, because the drive sheaves 127 and 104 are attached to rollers 124 and 125, rollers 124 and 125 will rotate opposite each other without the need to twist either belt 137 or belt 138. With the desired reversing of drive accomplished by coupling 101, being as above stated, to affect the proper speed and power to be delivered to driven roller 124 by sheave 127, one merely determines the speed and power needed and chooses either the appropriate size gear diameter between sheaves 115 and 116, the appropriate lateral or traverse diameter of drive grooves 128 and 129 so that O-rings 137 and 138 rotate about a certain circumferential diameter of drive grooves 128 and 129 within sheaves 115 and 116, the appropriate diameter of O-rings 137 and 138, again so that O-rings 137 and 138 rotate about a certain circumferential diameter of drive grooves 128 and 129 within sheaves 115 and 116 or a combination of the foregoing. In this manner the input to O-ring 137 will be reversed in rotation by coupling 101 and the desired speed and power output to O-ring 138 will be obtained. Then, because O-ring 138 is in driving contact with sheave 127, O-ring 137 will drive roller 124 in a rotational direction opposite that of rollers 125 and 126 and at the designed speed and power. Since the length of either O-ring can easily be changed, any distance change between the driving shaft sheave 104 over which O-ring 137 is placed and the driven shaft sheave 127 over which O-ring 138 is placed, does not require any change in the structure of reverse coupling 101. In addition, by merely changing the circumferential lengths of O-rings 137 and 138, the location of coupling 101, when placed into operation within copier 1, may be adjusted so as not to interfere with any other components of copier 1, again without the need for any structural alteration or modification to the design of coupling 101. This was not possible through the use of prior art transmission devices that required a stationary as opposed to a floating mount. In addition, since O-rings in themselves are resilient, the need for tensioning devices to assure a good frictional drive contact between the driving and driven components are also eliminated.

Figure 6:
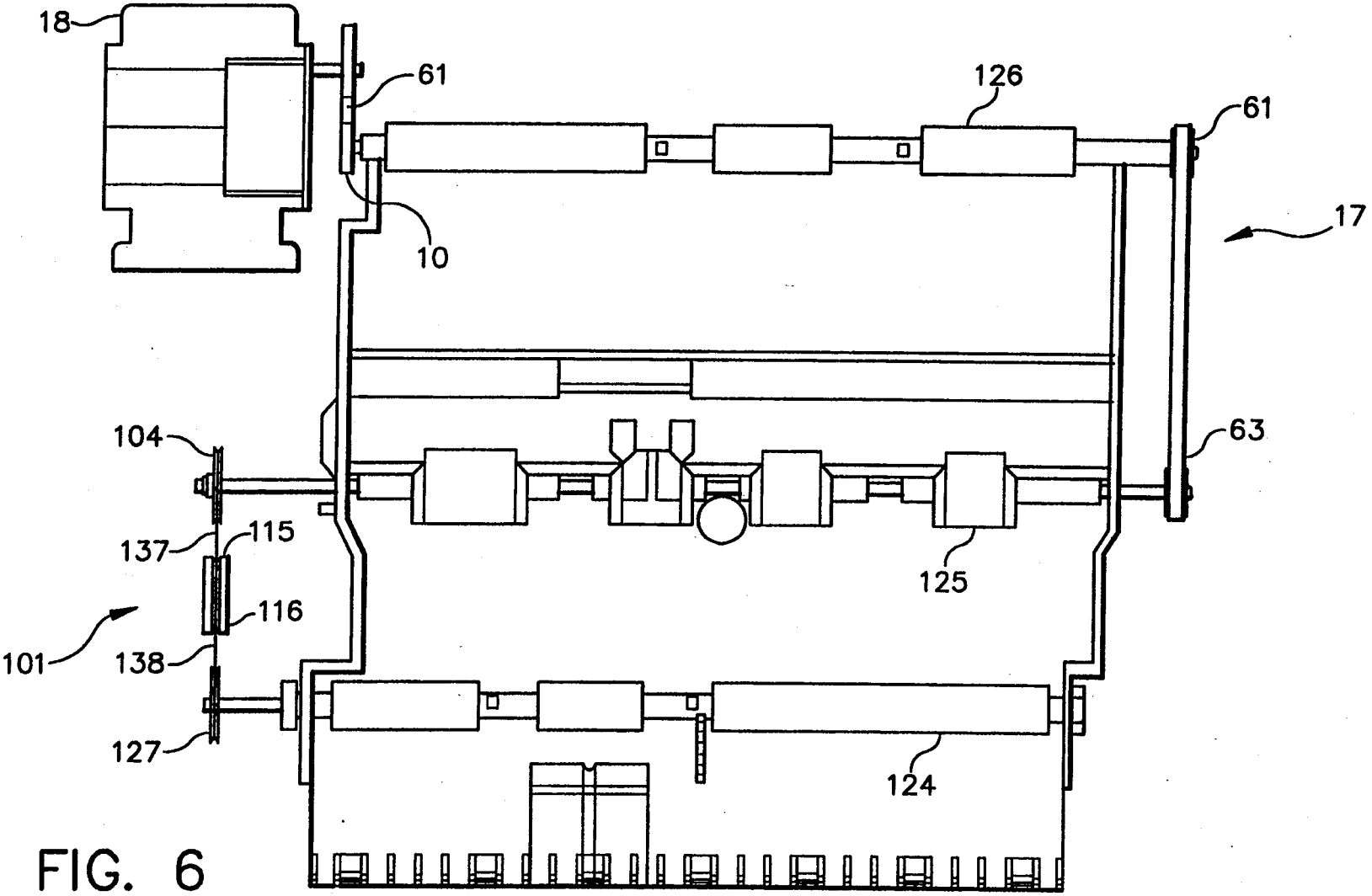
FIG. 6 is to top view of the reverse coupling of the present invention, used in combination with a typical paper transport of an electrophotographic reproduction device.

In operation, as shown in FIGS. 2 and 6, when coupling 101 is used in cooperation with a sheet transport system of a typical copier 1, the operator of copier 1 loads paper 10 into cassette 16 and turns on copier 1. This activates motor 18, which through a drive train not shown, but known in the art, drives scuff feed roller 20 to deliver sheet 10 to transfer platform 17. Motor 18 also drives sheave 60 through a conventional O-ring or belt means 61 so that roller 126 rotates in the same direction as motor 18 for the purpose of advancing sheet 10 along platform 17. Because a belt connects sheave 62 of roller 126 to sheave 63 of roller 125, roller 125 also rotates in the same direction as roller 126 for the advancement of sheet 10. Sheave 104 mounted to the side of roller 125 opposite to sheave 63, conveys the rotation of roller 125 to sheave 104 which in turn transmits said rotation to belt 137 of coupling 101. Belt 137 of coupling 101 then transmits that rotation to sheave 115 which rotation is then conveyed to sheave 116. Since the teeth of sheave 115 and 116 are in mating contact, sheaves 115 and 116 must, by necessity, rotate in opposite directions. With this being the case, sheave 116 conveys its rotation to belt 138 causing belt 138 to rotate in the opposite direction of belt 137, thereby causing sheave 127, in rotational contact with both belt 138 and roller 124, to rotate roller 124 in a direction opposite to that of rollers 125 and 126. Because coupling 101 floats between the support of belts 137 and 138 without the need of additional support, the circumferential length of belts 137 and 138 determine the positioning of coupling 101, within copier 1, so that coupling 101 does not interfere with any other components of copier 1. Due to the resilient nature of O-rings 137 and 138, the mere placing of O-rings 137 and 138 over sheaves 104 and 127 assures the necessary frictional drive contact between coupling 101 and drive sheave 104 of roller 125 and driven sheave 127 of roller 125 to transmit a rotational motion between rollers 124 and 125. Upon sheet 10 making contact with roller 124, it is fed under roller 124 and moved by the rotation of roller 124 toward rollers 125 and 126 where rollers 125 and 126 feed sheet 10 further along on platform 17. Ultimately sheet 10 is fed to transfer roller 5 where it meets with the images on web 2 and the images are transferred to sheet 10 before said images are fused to sheet 10 and released to the output of copier 1. In this manner, the rotation of any roller within copier 1 can be reversed and its speed and rotation power adjusted through the use of coupling 101 without the need to provide a support system to mount coupling 101.

While the invention has been described in detail with particular reference to a preferred embodiment thereof, it should be understood that variations and modifications can be effected within the spirit and scope of the invention and that said coupling can be used in other than a copier.

We claim as our invention:

1. An apparatus for feeding a sheet along a path having first and second opposite sides, said apparatus comprising:

a first feed roller positioned on the first side of said path, a second feed roller positioned on the second side of said path, first and second sheaves mounted for rotation with the first and second rollers, respectively, means for driving the first roller to advance the sheet along the path, a drive reversing coupling connected between the first and second rollers to drive the second roller in a direction reverse of the first roller to also advance the sheet along the path, said coupling including:

first and second gear sheaves, means supporting the gear sheaves with their gear portions meshed, a first O-ring entrained about the first gear sheave and the first sheave, and a second O-ring entrained about the second gear sheave and the second sheave.

2. The apparatus of claim 1 wherein the gear sheaves and their support are entirely supported by the O-rings to float between the first and second sheaves.

* * * * *